United States Patent [19]

Scodeller

[11] 4,134,221

[45] Jan. 16, 1979

[54] EARTH PLANER

[75] Inventor: Louis Scodeller, Windsor, Canada

[73] Assignee: Scofan Contractors Limited, Windsor, Canada

[21] Appl. No.: 839,247

[22] Filed: Oct. 4, 1977

[30] Foreign Application Priority Data

Jan. 2, 1977 [CA] Canada ..... 270800

[51] Int. Cl.[2] ..... E02F 3/46

[52] U.S. Cl. ..... 37/116; 214/133

[58] Field of Search ..... 37/115–117.5, 37/103, 108 R; 214/131 R, 146, 133, 138, 139, 141, 102; 212/55–57; 172/26.5

[56] References Cited

U.S. PATENT DOCUMENTS

| | | | |
|---|---|---|---|
| 1,100,052 | 6/1914 | Burke et al. | 37/117 X |
| 1,244,290 | 10/1917 | Cardwell | 37/116 |
| 1,316,058 | 9/1919 | Pugh | 37/116 X |
| 1,435,109 | 11/1922 | DeSanto | 37/116 X |
| 1,441,216 | 1/1923 | Corner | 37/116 X |
| 1,691,100 | 11/1928 | Wilson | 37/116 |
| 1,887,117 | 11/1932 | Colley | 37/116 |
| 1,906,760 | 5/1933 | Lehman | 37/117 |
| 3,166,205 | 1/1965 | Symmank | 214/138 R |
| 3,465,904 | 9/1969 | Pensa | 214/141 |
| 3,992,791 | 11/1976 | Dean | 37/116 |

FOREIGN PATENT DOCUMENTS

| | | | |
|---|---|---|---|
| 748223 | 10/1944 | Fed. Rep. of Germany | 37/117 |
| 1953906 | 12/1970 | Fed. Rep. of Germany | 37/116 |
| 352268 | 3/1961 | Switzerland | 37/116 |

*Primary Examiner*—E. H. Eickholt

*Attorney, Agent, or Firm*—Reising, Ethington, Barnard, Perry & Brooks

[57] ABSTRACT

An earth grading machine has a powered reciprocable earth moving element guided by a vertically inclinable track member. Means for adjusting the vertical inclination of the track member includes support means accommodating pivotal movement of the track member in a vertical plane about both a first axis adjacent one end of the track member and about a second axis spaced longitudinally of the track member from said first axis-.Adjustable means effects raising and lowering of the second axis.Adjustable length means interconnects the track member and its support means in laterally offset relation to the first axis, and comprises a hydraulic cylinder pivotally connected to the support means, and a piston movable in response to hydraulic pressure within the cylinder, said piston being pivotally connected to the track member.

10 Claims, 6 Drawing Figures

EARTH PLANER

FIELD OF INVENTION

My invention relates to earth grading machines, and its principal object is to provide such a machine for grading to precise slopes.

In many types of grading operations, as are involved, for example, in improving river banks, raised road embankments, etc., close tolerances of only a few degrees are increasingly being specified to better insure against subsequent erosion. Heretofore this has been obtainable only at a great expenditure of time and cost, frequently involving much hand labor, and has been an even greater problem in the case of sloping the underwater portions of river banks.

The machine of my invention which solves this problem employes a reciprocating earth moving element, such as a scraper blade, whose reciprocatory movement is guided by a vertically inclinable track member designed to extend out over the area to be graded and having novel support means for adjusting and fixedly positioning its angle of inclination.

BRIEF DESCRIPTION OF PRIOR ART

I am aware of it being old in the prior art, such as U.S. Pat. Nos. 1,244,290 - Cardwell and 1,887,117 - Colley, to simply guide reciprocatory movements of a scraper blade by providing it with rollers to run in track channels attached to the main boom of a crane or the like, and that it is old as shown in U.S. Pat. No. 2,873,871 - Waite to employ hydraulic cylinder units to lock the boom of a backhoe or the like against upward tilting movement relative to its power unit. However all of these and like prior machines are incapable of accomplishing the results obtainable from my invention since they lack the means for positively assuring a selected angle of grading slope.

SUMMARY OF INVENTION

In accordance with my invention the track member, which extends over the work area to be graded is pivotally supported for adjustment of its vertical inclination about two spaced axes, both of which may be held fixed by the supporting structure during reciprocation of the scraper blade or other earth moving element. Power means associated with the supporting structure is provided for adjustably raising and lowering the first of these pivotal axes, and other adjustable means is provided for locking the track member against further pivotal movement at any selected elevation of such first axis. Preferably the second pivotal axis is located adjacent the end of the track member away from the work area, and the adjustable locking means comprises a hydraulic power cylinder and piston unit pivotally interconnecting the track member and a strut which pivotally interconnects such end of the track member to the supporting structure.

The means by which these and other objects and advantages of the invention are attained will be better understood from the following description of one preferred embodiment selected for illustration, having reference to the attached drawings, wherein:

BRIEF DESCRIPTION OF DRAWINGS

as seen in FIG. 1.

DETAILED DESCRIPTION OF ILLUSTRATED EMBODIMENT

Figure 1:
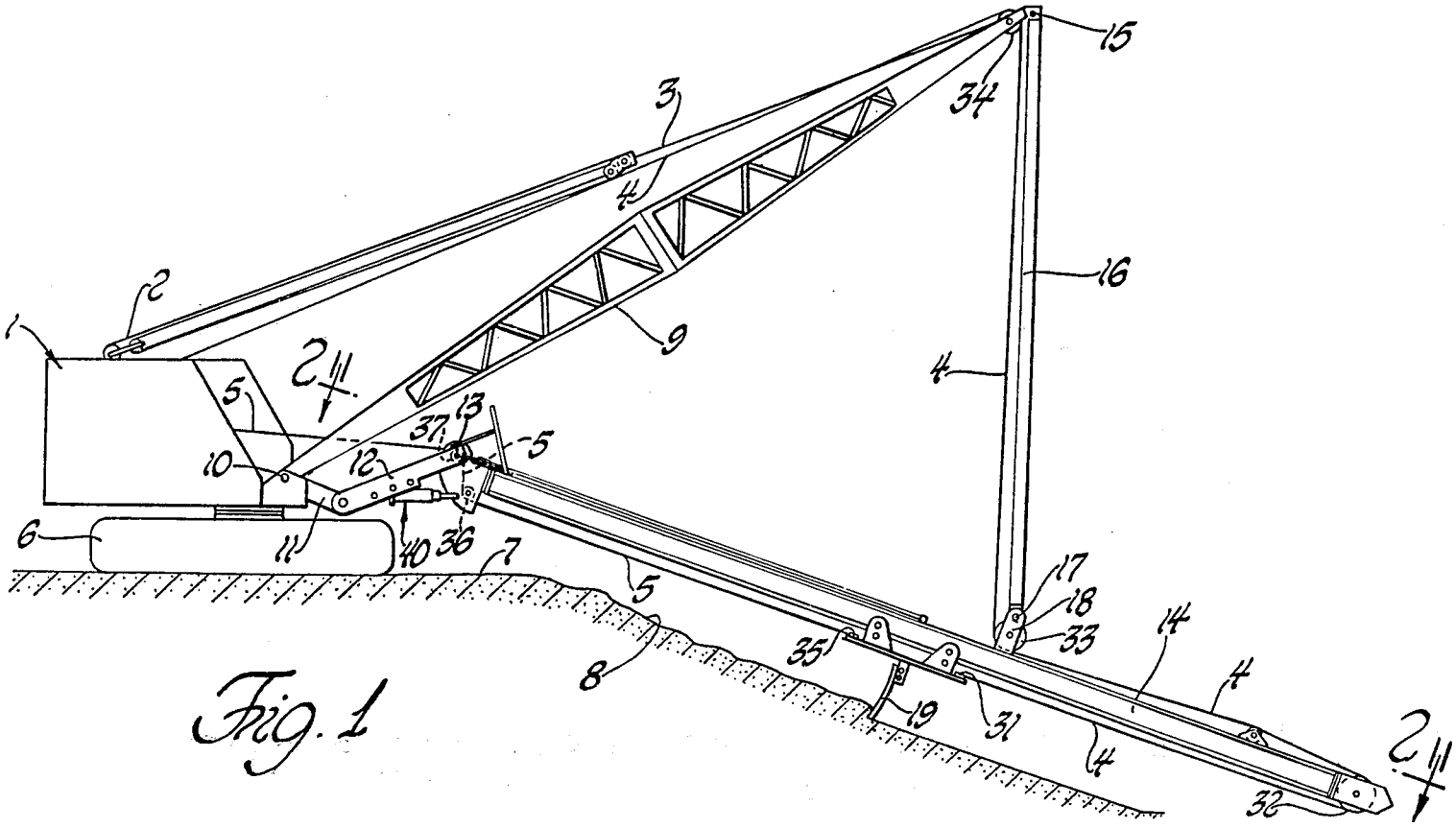
FIG. 1 is a side elevational view of an earth grading machine constructed in accordance with my invention.
Figure 2:
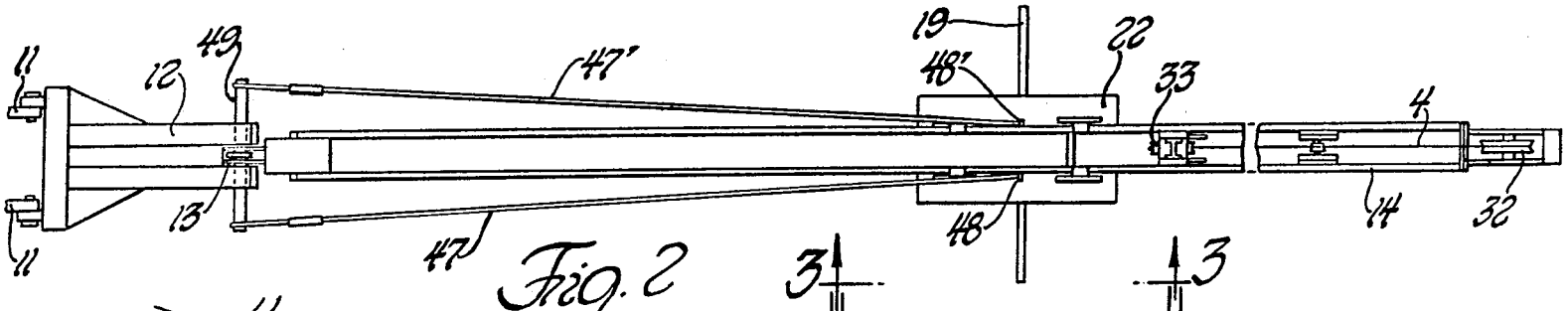
FIG. 2 is an enlarged fragmental view of the track member and related parts, taken in the direction of the arrows 2—2 in FIG. 1.

Referring now in detail to the drawings, and first to FIG. 1, the numeral 1 designates the power unit of a conventional derrick or crane-type device containing the usual take-up reels (not shown) which, in conjunction with the pull cables 2, 3, 4 and 5, comprise the power means for controlling and operating the earth grading parts of the machine to be hereinafter described. As shown, this power unit is preferably of the self-propelled type, being mounted on crawler treads 6 which support it on the ground 7 adjacent a work area 8 to be graded. 9 indicates a boom extending upwardly and outwardly from the power unit, with its lower end pivotally connected thereto at 10. This boom is adjustably raisable and lowerable from its position shown, about the pivot 10, by taking up or letting out the pull cable 2 which, in turn, transmits such motion to the extended end of the boom via the pull cable 3.

Welded or otherwise permanently fixed to the base of the power unit supporting the pivot 10 are a pair of projections 11, 11' to which one end of a lower link or strut 12 is pivotally connected for movement in a vertical plane. Extending from the other end of this strut 12 and having a pivotal connection 13 thereto is a vertically inclinable track member 14 which is of sufficient length to overlie the width of the work area 8 to be graded. Pivotally connected at 15 to the extended end of the boom 9 is a depending strut 16 whose lower end has a pivotal connection 17 to a bracket 18 projecting upwardly from and welded or otherwise fixed to the track member at a distance longitudinally of the latter from the pivotal connection 13.

Figure 4:
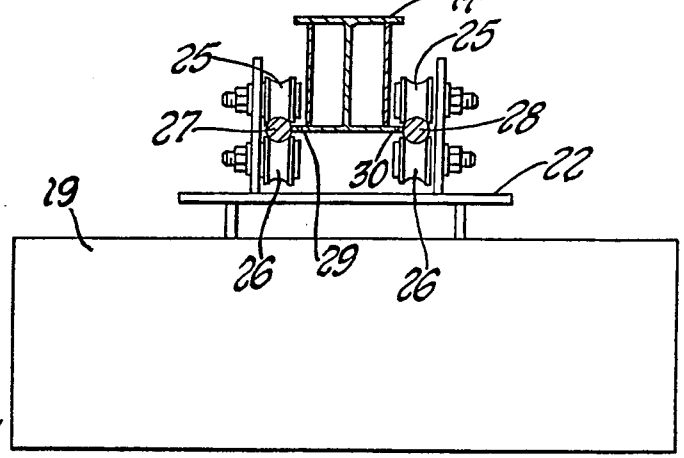
FIG. 4 is a fragmental view, partly in elevation and and partly in section, as viewed in the direction of the arrows 4—4 in FIG. 3.
Figure 3:
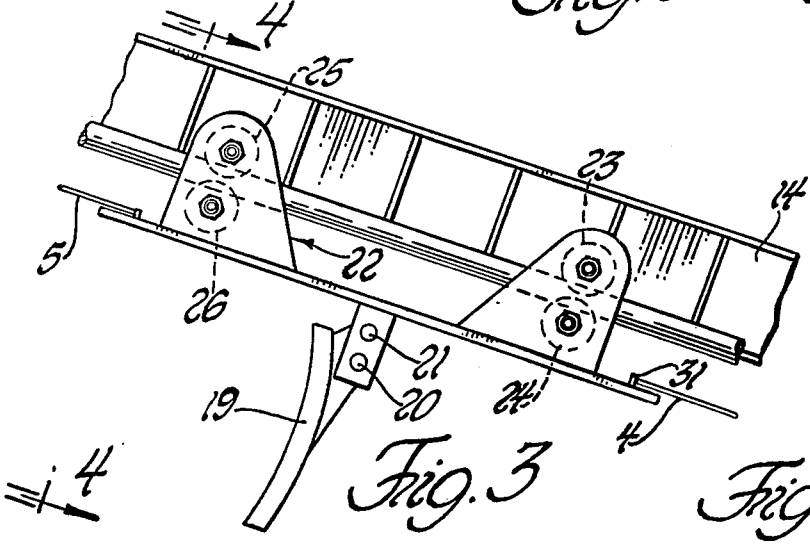
FIG. 3 is a further enlarged fragmental view of a portion of the track member and its guided scraper blade, taken in the direction of the arrows 3—3 in FIG. 2.

The track member guides reciprocatory movements of an earth moving element, shown in the form of a scraper blade 19. As best seen in FIGS. 3 and 4, this scraper blade is suitably fixed, as by pins 20 and 21, to a carriage 22 having two sets of upper and lower rollers 23, 24 and 25, 26 which respectively overlie and underlie spherically formed edge sections 27 and 28 of outwardly extending flanges 29, 30 on the track member. Retractive movement of the scraper blade outwardly of the track member, i.e. away from the power unit 1, is effected by the pull cable 4 which is attached at 31 to the carriage 22 and extends over a first sheave 32 (FIG. 1) journaled on the extended end of the track member, thence back over a second sheave 33 journaled in the track member bracket 18 adjacent the lower end of the depending strut 16, and thence over a third sheave 34 on the extended end of the boom to a conventional take-up reel (not shown) in the power unit 1.

Conversely, upon reverse rotation of such take-up reel, the pull cable 5, which is attached at 35 to the rear end of the carriage 22, passes over a fourth sheave 36 journaled on the track member below the pivotal connection 13, thence upwardly and over a fifth sheave 37 journaled on the track member coaxially with the pivotal connection 13, causing the scraper blade to move toward the power unit on its working stroke.

As thus far described it will be appreciated that the track member 14, and hence the reciprocatory path of movement of the scraper blade 19, is vertically inclinable about both the horizontal axis provided by the pivotal connection 13 and the horizontal axis provided by the pivotal connection 17. Adjustably raising and lowering of the boom by means of the cables 2 and 3, as previously described, operates through the depending strut 16 to alter the inclination of the track member 14.

Figure 5:
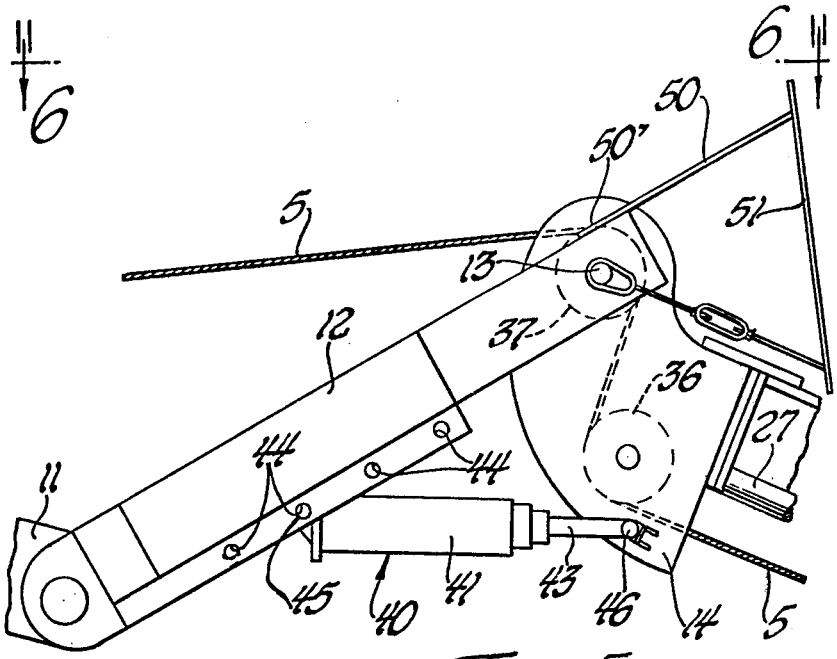
FIG. 5 is a further enlarged fragmental view in side elevation, showing details of the interconnection of the track member to its lower supporting strut, hydraulic locking cylinder, etc.
Figure 6:
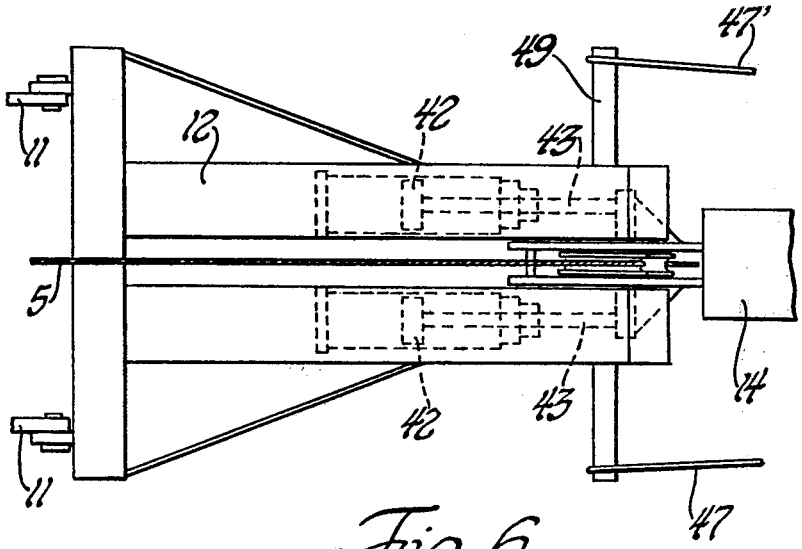
FIG. 6 is a fragmental plan view, taken in the direction of the arrows 6—6 in FIG. 5.

The degree of inclination of the track member, for any such selected elevation of the boom, may be precisely controlled in accordance with the invention by adjustable length means associated with the pivotal connection 13 between the lower strut 12 and the track member. This adjustable length means, designated generally by the numeral 40, is best seen in FIGS. 5 and 6 in the form of laterally spaced, parallel operating, hydraulic pressure cylinder and piston units. Each comprises a cylinder 41 closed at one end and having a double acting piston 42 therein with its piston rod 43 extending from and movable outwardly of the opposite end in response to hydraulic pressure within the cylinder. Introduction of hydraulic fluid to the respective ends of the cylinders is provided by conventional high pressure conduits from a suitable pressure source with the usual valve controls, etc. (not shown). Each of the cylinders 41 has its closed end pivotally connected to the lower strut 12, at one of a plurality of spaced holes 44 provided therein for receiving a pin 45 on the cylinder, and the piston rods 43 are each pivotally connected at 46 to the track member, below the sheave 36. Guy wires 47, 47', extending between suitable anchorages 48, 48' on laterally opposite sides of the track member and the opposite ends of a cross member 49 welded to the lower strut, are provided for restraining lateral displacement of the track member.

It will be noted that both the pivotal connections between the piston rods and the track member, as well as each of the holes 44 for pivotally connecting the cylinders to the lower strut 12, are spaced from the axis of inclination of the track member about its pivotal connection 13 to the lower strut. Accordingly, the cylinder and piston units are operable as adjustable length means, interconnecting the track member and lower strut in laterally offset relation to such axis, to adjustably alter the inclination of the track member independently of any selected elevation of its other pivotal connection 17. Such adjustment, it will be appreciated, may be simply carried out by regulation of the hydraulic fluid pressures in the respective ends of the cylinders.

Also, the cylinder and piston units, when effectively equal hydraulic pressures are maintained at opposite ends of their pistons, serve as adjustable means for locking the track member against pivotal movement relative to the lower strut 12. Such an adjusted locked condition is normally maintained during the grading stroke of blade 19 toward the power unit, because with the boom 9 then at a pre-set height, the boom, track member, strut 16 and lower strut 12 operate effectively as a rigid structure insuring a straight-line path of movement of the scraper blade. Also, when desiring to adjust the inclination of the track member it may on occasion be advantageous to maintain the locked relation of the track member and lower strut 12, and simply effect such adjustment by raising or lowering the boom by means of the pull cables 2 and 3, such adjustment being accommodated by pivotal movement of the lower strut about its pivotal connection to the power unit.

The operation of the machine is believed clear from the description heretofore given of the functions of its various parts, and it should accordingly suffice merely to point out that during a grading operation the operator may alter the slope of the blade travel between each working stroke by either adjusting the height of the boom, or by adjusting the length of the hydraulic cylinder and piston units. A simple form of indicator of the inclination of the track member relative to the lower strut may be fashioned in the form of two steel rods 50 and 51 as shown in FIGS. 1 and 5. The rod 50 has its end 50' welded or otherwise fixed to the lower strut 12 so as to extend therefrom for abutment with the rod 51 whose lower end is suitably fixed to the track member 14. By adjustably bending the rod 51 for abutment with the extended end of the rod 50 while the track member is in a pre-selected inclination to effect the slope of grading desired, the operator may readily determine, after each alteration of the track member inclination, just how much adjustment is required to return it to the preselected angle.

Also, where necessary to effect a considerable change in the range of adjustment of the track member inclination, as might be required to meet different grading slope specifications, the cylinder pivot connections to the lower strut may be shifted as necessary to one or the other of the holes 44 therein.

While my invention has been disclosed with reference to only one embodiment, selected to best illustrate the principles involved, it is appreciated that minor changes in the various parts and their arrangement may be made without departing from the spirit and scope thereof. For a definition of the invention reference is made to the appended claims.

What is claimed is:

1. An earth grading machine comprising a reciprocable earth moving element, a vertically inclinable track member guiding reciprocatory movements of the earth moving element, power means for reciprocating said element, and means for adjusting the vertical inclination of the track member, said last named means including support means accommodating pivotal movement of the track member in a vertical plane about both a first axis adjacent one end of the track member and about a second axis spaced longitudinally of the track member from said first axis, means for adjustably raising and lowering said second axis, and adjustable length means interconnecting the track member and its support means in laterally offset relation to said first axis.

2. The machine of claim 1, wherein said adjustable length means comprises a hydraulic cylinder pivotally connected to one of said track member and support means, and a piston movable in response to hydraulic pressure within the cylinder, said piston being pivotally connected to the other of said track member and support means.

3. The machine of claim 2, wherein said adjustable length means also comprises a second hydraulic cylinder and piston pivotally interconnecting the track member and support means in laterally spaced relation to said first named cylinder and piston, and wherein both said cylinders and pistons are disposed below said first axis.

4. An earth grading machine comprising a power unit, a boom pivotally connected to and extending from the power unit, a generally vertical first strut depending from and pivotally connected at its upper end to the boom, a vertically inclinable track member disposed below the boom and pivotally connected to the lower end of said first strut, a second strut pivotally connected at one of its ends to the power unit and having a pivotal connection at its opposite end to one end of the track member, adjustable locking means for said pivotal connection, an earth moving element reciprocably guided by the track member for movement toward and away from the power unit and means actuatable by the power unit for reciprocating said element along the track member.

5. The machine of claim 4, wherein said adjustable locking means comprises a cylinder having a hydraulic pressure movable piston therein, one of said cylinder and piston being connected to said second strut and the other of said cylinder and piston being connected to the track member.

6. The machine of claim 4, wherein said last named means includes a first sheave on the opposite end of the track member from said second strut, a second sheave on the track member adjacent the lower end of the first strut, a third sheave on the boom, a fourth sheave on the track member at said pivotal connection to the second strut, a fifth sheave on the track member below said pivotal connection, a first cable extending from the power unit over said third, second and first cables to the earth moving element and a second cable extending from the earth moving element over said fourth and fifth sheaves to the power unit.

7. The machine of claim 4, including cable means actuated by the power unit and connected to the boom for adjustably raising and lowering of the extended end of the boom and thereby altering the vertical inclination of the track member.

8. The machine of claim 7, wherein said adjustable locking means comprises a pair of cylinders in spaced side-by-side relation, each having a hydraulic pressure responsive piston therein, said cylinders being connected to one of said second strut and track member, said pistons being connected to the other of said second strut and track member.

9. An earth grading machine comprising a reciprocable earth moving element, a vertically inclinable track member guiding reciprocatory movements of the earth moving element, support means for said track member accommodating its pivotal movement in a vertical plane about both a first axis adjacent one end of the track member and about a second axis spaced longitudinally of the track member from said first axis, power means associated with said support means for adjustably raising and lowering said second axis, other power means for reciprocating said earth moving element, and adjustable length means interconnecting the track member and support means in laterally offset relation to said first axis for selectively fixing the vertical inclination of the track member at various adjusted heights of said second axis.

10. An earth grading machine comprising a reciprocable earth moving element, a vertically inclinable track member guiding reciprocatory movements of the earth moving element, support means opposite one end of the track member, said track member having a first pivotal connection to said support means accommodating adjustment of the vertical inclination of the track member, means carried by said support means having a pivotal connection to the track member remote from and cooperating with said first pivotal connection in accommodating adjustment of the vertical inclination of the track member, adjustable locking means at one of said pivotal connections for fixably setting the vertical inclination of the track member, and power means for reciprocating the earth moving element.

* * * * *